US008827422B2

(12) United States Patent
Kodoi et al.

(10) Patent No.: US 8,827,422 B2
(45) Date of Patent: Sep. 9, 2014

(54) LIQUID EJECTION HEAD AND METHOD OF PRODUCTION THEREOF

(75) Inventors: Takuma Kodoi, Kawasaki (JP); Yasunori Takei, Tokyo (JP); Kenji Yabe, Yokohama (JP); Isamu Horiuchi, Yokohama (JP); Hyo Takahashi, Kawasaki (JP); Ken Ikegame, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/480,637

(22) Filed: May 25, 2012

(65) Prior Publication Data

US 2012/0306969 A1 Dec. 6, 2012

(30) Foreign Application Priority Data

Jun. 1, 2011 (JP) ..... 2011-123398

(51) Int. Cl.
*B41J 2/05* (2006.01)

(52) U.S. Cl.
USPC ..... 347/47

(58) Field of Classification Search
USPC ..... 347/40, 43, 47
See application file for complete search history.

(56) References Cited

U.S. PATENT DOCUMENTS

| | | | | |
|---|---|---|---|---|
| 6,022,100 | A | 2/2000 | Takenouchi et al. | |
| 6,527,377 | B1 | 3/2003 | Ikegame et al. | |
| 7,506,962 | B2 | 3/2009 | Murakami et al. | |
| 7,641,312 | B2 * | 1/2010 | Takahashi | 347/45 |
| 2011/0120627 | A1 | 5/2011 | Mihara et al. | |
| 2012/0021360 | A1 | 1/2012 | Ikegame et al. | |
| 2012/0047736 | A1 | 3/2012 | Horiuchi | |
| 2012/0105546 | A1 | 5/2012 | Horiuchi et al. | |

FOREIGN PATENT DOCUMENTS

JP 2001-347663 A 12/2001

* cited by examiner

*Primary Examiner* — Lamson Nguyen
(74) *Attorney, Agent, or Firm* — Fitzpatrick, Cella, Harper & Scinto

(57) ABSTRACT

Without being dependent on design changes, a liquid ejection head and a method of production thereof are provided in which when time-division driving, liquid drop landing deviance in the direction of printing is capable of being corrected. In order to achieve this, before performing an exposure in order to form an ejection port, after forming a cavity that is shifted with respect to the location at which the ejection port is formed, exposure is performed.

7 Claims, 6 Drawing Sheets

FIRST EJECTED NOZZLE
PRINTING DIRECTION
EJECTED DROP
PRINT MEDIUM

SECOND STRUCK NOZZLE
PRINTING DIRECTION
EJECTED DROP
DROPS EJECTED ON PRINT MEDIUM

THIRD STRUCK NOZZLE
PRINTING DIRECTION
EJECTED DROP
DROPS EJECTED ON PRINT MEDIUM

DROPS EJECTED ON PRINT MEDIUM

LIQUID EJECTION HEAD AND METHOD OF PRODUCTION THEREOF

BACKGROUND OF THE INVENTION

1. Field of the Invention

The invention relates to an inkjet printing head for performing the ejection of ink on a print medium as drops, and a method of manufacturing an inkjet printing head. The invention may be applied to a general printing device, and in addition the invention may be applied to a copier, a fax machine having a communications system, a word processing device, etc., having a print section, and an industrial use printing apparatus in which various processing devices are combined together.

2. Description of the Related Art

In inkjet printers of recent years, high speed printing has become possible due to an increase in refill frequency in the liquid ejection heads, due to technological advances. In carrying out printing, time-division driving is routinely performed as it is necessary to restrain voltage drop due to the increase of current momentarily flowing to heaters and electrodes, and to provide a high duty image at a high quality. When high speed printing and time-division driving are combined, however, when printing ruled lines, etc., a negative effect often occurs wherein it is not possible to form straight lines, etc.

It is necessary to implement an ejection scheme in order to bring these techniques together. With respect to such problems, Japanese Patent Laid-Open No. 2001-347663 proposes a means of correcting landing position by way of shifting the positional relationship between the heating elements and ejection ports. More specifically, it describes preserving image linearity even in the case of performing time-division driving by way of arranging either of the heating elements or the ejection ports in an approximately straight line and relatively shifting the positions of the heating elements and the ejection ports.

It is also described therein that if with respect to all nozzles the heating elements and the space at the bifurcated position from the ink supply port to the ink flow paths are made as close as possible to within manufacturing tolerances it is possible to raise refill frequency to its maximum and improve printer throughput.

With the method of resolution set forth in Japanese Patent Laid-Open No. 2001-347663, however, the shape of the heating elements is changed, and in the case of a higher aspect ratio or a lower ejection amount, bending of liquid drops decreases and it becomes difficult to achieve the expected landing position correction. In short, the design range of the shape of the heating elements or the ejection amounts, etc., in which the effect is exhibited, is limited, and there was a possibility that the degree of design freedom was narrowed.

SUMMARY OF THE INVENTION

Thus, taking into account the above described issues, it is an object of the invention to provide, without reliance on design changes, a liquid ejection head and a method of production thereof in which, when time-division driving, liquid drop landing deviance in the printing direction is capable of being corrected.

The invention is characterized by a method of producing a liquid ejection head that is to be mounted in a printing apparatus and that is for ejecting liquid while scanning, comprising: a step for forming in a photosensitive resin an ejection port array comprising a plurality of ejection ports for ejecting liquid, by exposing the photosensitive resin; and a step for forming, before performing the exposure, on a surface of a portion forming the ejection ports of the photosensitive resin, cavities that are shifted more in a scanning direction as the order in which an ejection port ejects in the ejection port array is earlier.

According to the invention, a method of manufacturing a liquid ejection head has a step for forming, before performing exposure, on a surface of a portion forming ejection ports of photosensitive resin, cavities that are shifted more in a scanning direction as the order in which an ejection port ejects in the ejection port array is earlier. Accordingly, without being dependent on design changes, it is possible to achieve a liquid ejection head and a method of production thereof in which when time-division driving liquid drop landing deviance in the printing direction is capable of correction.

Further features of the invention will become apparent from the following description of exemplary embodiments (with reference to the attached drawings).

DESCRIPTION OF THE EMBODIMENTS

First Embodiment (Basic Configuration)

Figure 1A:
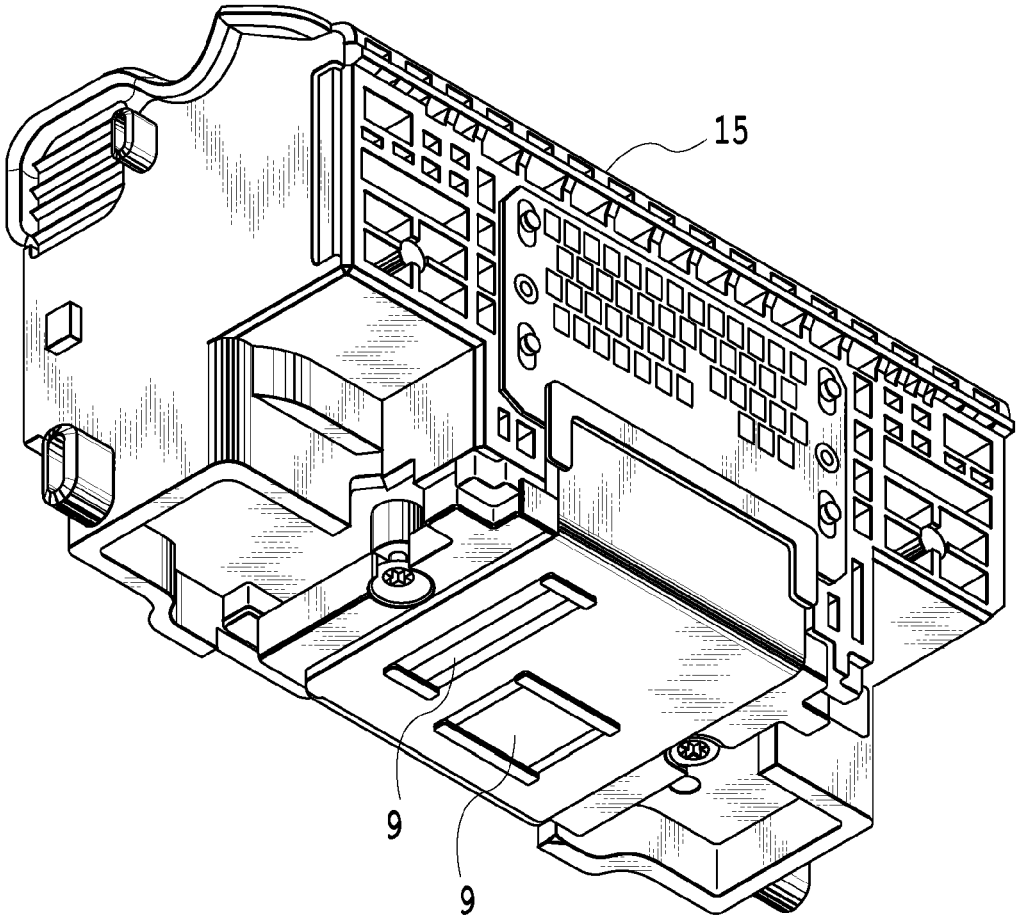
FIG. 1A is a drawing that illustrates a liquid ejection head of an inkjet printing apparatus.

The basic configuration of a first embodiment of the invention will be described below while referring to the drawings.

Note that in the explanation below there are cases where a structure having the same function as another is marked with the same reference, and the corresponding explanation omitted. As for the explanation below, the construction of a liquid ejection head mounted on an inkjet printing apparatus was raised as an example, but in addition it is also capable of being applied in the case of forming chips and circuits by the same means, with a semiconductor exposure apparatus.

Figure 1B:
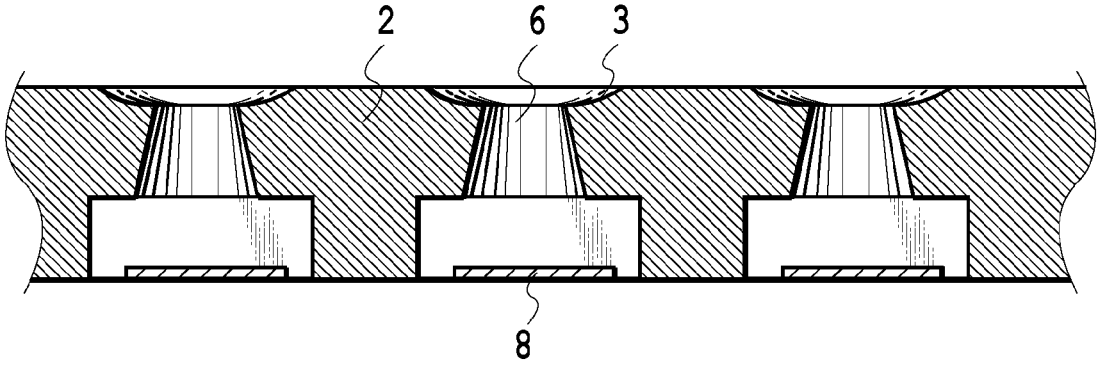
FIG. 1B is a cross sectional view illustrating ejection ports.

FIG. 1A is a drawing that shows a liquid ejection head 15 of an inkjet printing apparatus to which the invention can be applied, and FIG. 1B is a cross section view showing the vicinity at the ejection ports of the liquid ejection head of FIG. 1A. The liquid ejection head 15 manufactured according to the invention has a chip 9 on which heat generation elements 8, which are used for ejecting ink, are arranged at a prescribed pitch.

On chip 9 an ink supply port, which supplies ink, is open to the space between the rows of heat generation elements 8. On the chip 9 ejection ports 6 that are open to the upper regions of each of the heat generation elements 8, and separate ink flow paths that communicate from the ink supply port to each of the ejection ports 6, are formed in a photosensitive resin film 2, which is the member that forms the ejection ports 6.

The liquid ejection head 15 is arranged such that the surface on which the ejection ports 6 are formed faces the printing surface of the print medium. The liquid ejection head 15 causes liquid to be ejected from the ejection ports 6 by applying pressure, generated by the heat generation elements 8, to the liquid filled in flow paths via the ink supply port.

Figure 2:
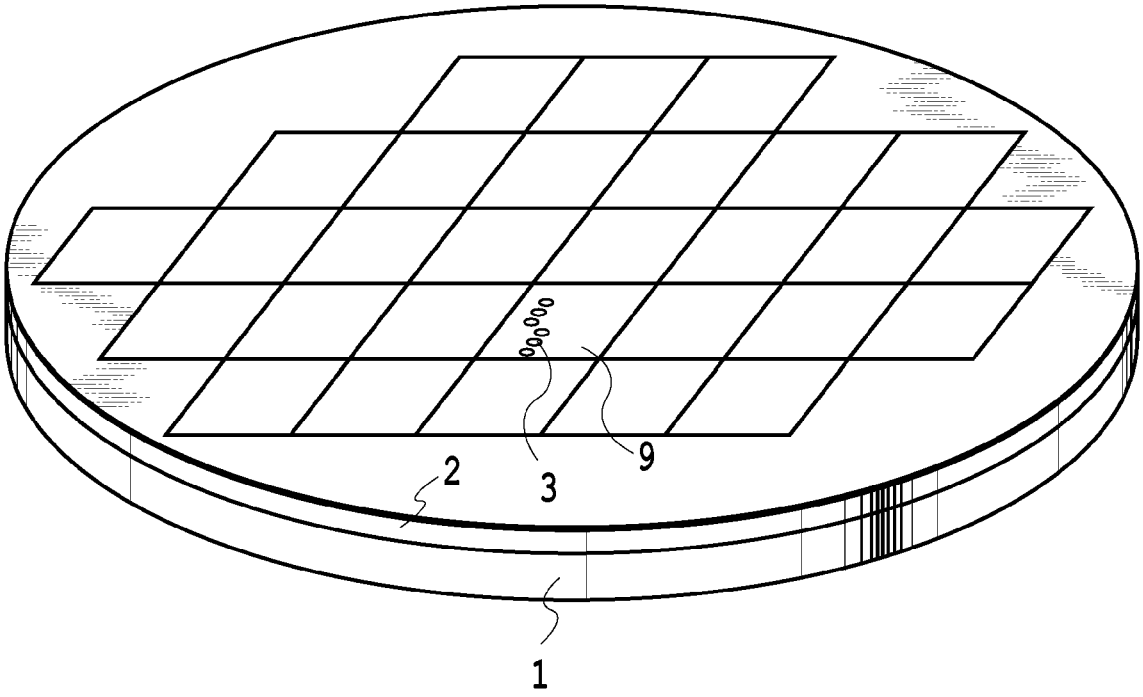
FIG. 2 is a drawing illustrating a silicon wafer for forming chips.

Next, the method of manufacturing the liquid ejection head 15 of this embodiment will be explained below. FIG. 2 is a drawing that illustrates a silicon wafer 1, which is for forming chip 9 and to which the invention is capable of being applied. On the silicon wafer 1, on which heat generation elements 8 (refer to FIG. 1B) are formed, a photosensitive resin film 2 is formed, after forming flow paths. After forming the photosensitive resin film 2, before an ejection port row is formed, cavities 3, which have an approximately arced shape (a 3D curved surface), are provided at the locations where the ejection port arrays are to be formed. There is a means for forming, via exposure, the ejection ports 6 at the regions above the heat generation elements, and forming the nozzle portions (refer to FIG. 1B).

To be more precise, on the silicon wafer 1 on which the heat generation elements 8 and flow path portions, or flow path molds, are formed, a negative-type photosensitive resin film 2 is formed. The negative type photosensitive resin film that is preferably used here is explained below. The means for forming this negative-type photosensitive resin film on the silicon wafer 1 is capable of using spin coat methods, roll coat methods, and slit coat methods, etc. Note that with respect to this explanation, while a configuration is not explained wherein a pattern is provided that becomes a flow path mold, methods that use a pattern that becomes a mold, and methods that do not use molds are both included in the invention. An example of the invention that was considered this time is shown below, and the invention is explained in further detail.

Composition of the Negative-Type Photosensitive Resin

| | |
|---|---|
| Epoxy resin: EHPE-3150 (manufactured by Daicel Chemical Co.) | 120 g |
| Light cation polymerization initiator: SP-172 (manufactured by Asahi Denka Kogyo Co.) | 6 g |
| Sensitizing agent: SP-100 (manufactured by Asahi Denka Kogyo Co.) | 1.2 g |
| Methyl isobutyl ketone | 100 g |

A negative-type photosensitive resin containing such materials was prepared. This negative-type photosensitive resin was applied at a film thickness of 1 μm to a quartz glass substrate, and the absorbance measured at 365 nm was 0.024.

The liquid ejection head 15 was made using a negative-type photosensitive resin such as that described above. First, an electro-thermal conversion element 8 (a heater formed from HfB2 material), serving as an ink ejection heat generation element, and a silicon wafer 1 having a SiN+Ta lamination film (not shown) at the region where the flow path is formed, were prepared. Next, on a substrate containing energy generation elements 8, polymethyl isopropenyl ketone (ODUR, manufactured by Tokyo Ohka Kogyo) was spun coated as positive-type photosensitive resin, and baking was performed for 3 min. at a temperature of 150° C.

Next, patterning of the positive-type photosensitive resin was performed. Deep-UV Exposure Apparatus UX-3000, manufactured by Ushio Electric, was used as the exposure apparatus, and patterning exposure was performed at an exposure amount of 23000 mJ/cm$^2$. Next, development was performed with methyl isobutyl ketone, rinse processing was performed with isopropyl alcohol, and a flow path pattern was formed. Next, on the silicon wafer that has passed through the above steps, the earlier prepared negative-type photosensitive resin is spun coated, and the negative-type photosensitive resin film 2 is formed. Note that because the formation of an ink repellant layer would not make sense in the invention its explanation has been omitted.

(Characteristic Features)

Characteristic features of the invention will be explained below.

Figure 3A:
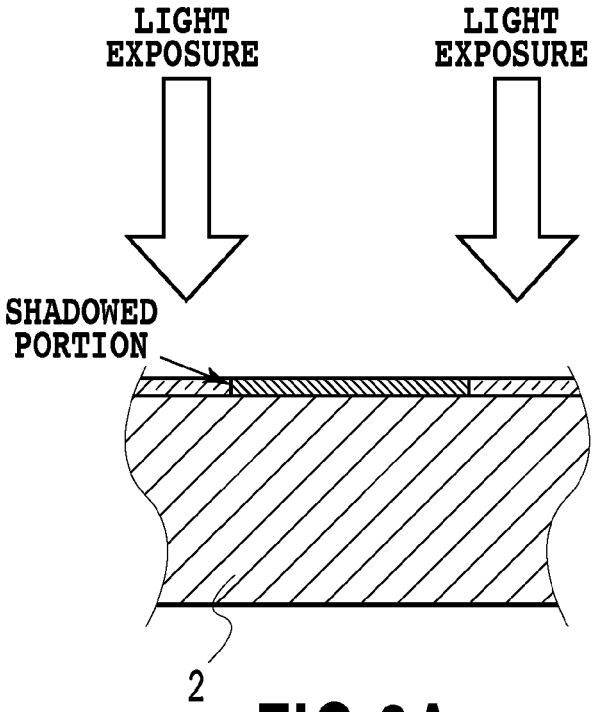
FIG. 3A is a drawing that incrementally shows the process of forming an ejection port of an embodiment of the invention.
Figure 3B:
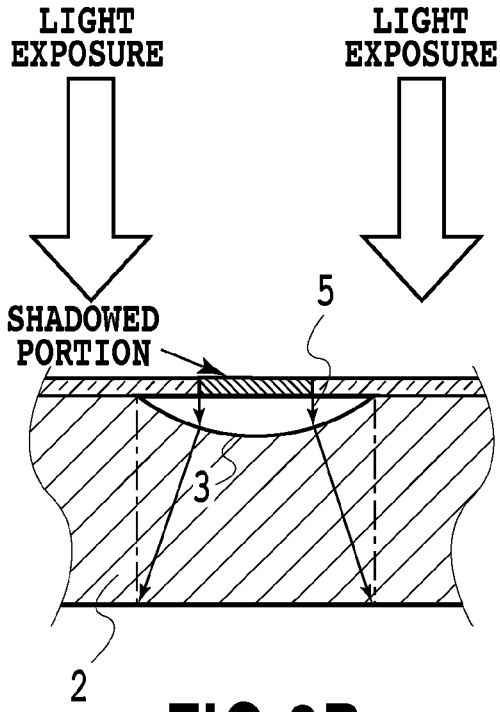
FIG. 3B is a drawing that incrementally shows the process of forming an ejection port of an embodiment of the invention.

FIGS. 3A to 3D are drawings that incrementally show the process of forming an ejection port 6 of this embodiment. First, as shown at FIG. 3A, when just a little hardening shrinkage occurs on the negative-type photosensitive resin film 2, baking is performed. Due to this, as shown at FIG. 3B, a cavity 3 is formed at the ejection port formation location at the upper (in the figure) region of the photosensitive resin film 2. In this way the cavities 3 are formed at the upper regions of the ejection ports 6 before the exposure at which the ejection port rows are formed is performed. In forming the cavity 3, weak exposure of a degree by which hardening is not completed, and a bake of a short period of time, is applied to the photosensitive resin layer 2. In this case a cavity 3 with a diameter of 35 μm and a depth of 4.4 μm was formed by carrying out an exposure amount of 2500 J/m$^2$, and the bake for 4 minutes at a temperature of 100° C. The means of forming the cavity 3 is not so limited, however; in the steps of the process cavities 3 are formed at the photosensitive resin layer 2, at the locations where the ejection port nozzle array is patterned.

Figure 3C:
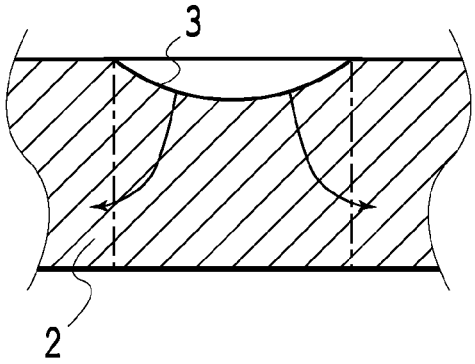
FIG. 3C is a drawing that incrementally shows the process of forming an ejection port of an embodiment of the invention.
Figure 3D:
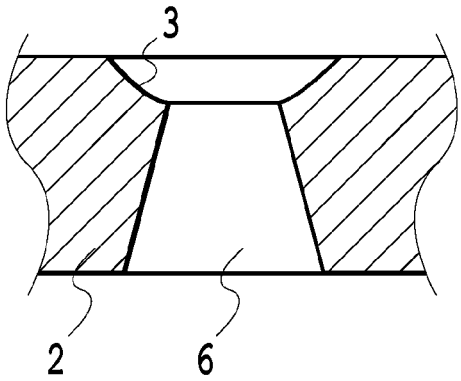
FIG. 3D is a drawing that incrementally shows the process of forming an ejection port of an embodiment of the invention.

Next, as shown at FIG. 3C, patterning of the negative-type photosensitive resin film was performed above the cavity 3. At FIG. 3 the shadowed portion is arranged directly on the upper portion of the photosensitive resin layer 2 for the purpose of simplification, but in actuality a patterning is preferred that is due to an exposure wherein a semiconductor exposure apparatus is put between a reticle (mask) and the silicon wafer 1. Here, via the reticle, using an i-line stepper (manufactured by Canon), patterning exposure was performed at an exposure amount of 3500 J/m$^2$, with light having a central wavelength of 365 nm and a half-width of 5 nm.

After that baking was performed in succession on a hot plate at 90° C. for 4 minutes, development was performed with methyl isobutyl ketone, and after performing rinse processing with isopropyl alcohol, heat processing was performed for 60 seconds at 100° C., and the ejection port 6 was formed. At FIG. 3D an ejection port and a cavity 3 completed by this process are shown. The liquid ejection head of the invention is manufactured using the above principles. Note, however, that the proportion of the composition of materials, and the conditions used here is an example, and that the invention is not so limited. In addition, the method of forming the cavity 3 is not limited to the example; it is sufficient that a shape is created before pattern exposure for formation of the ejection port.

Figure 4A:
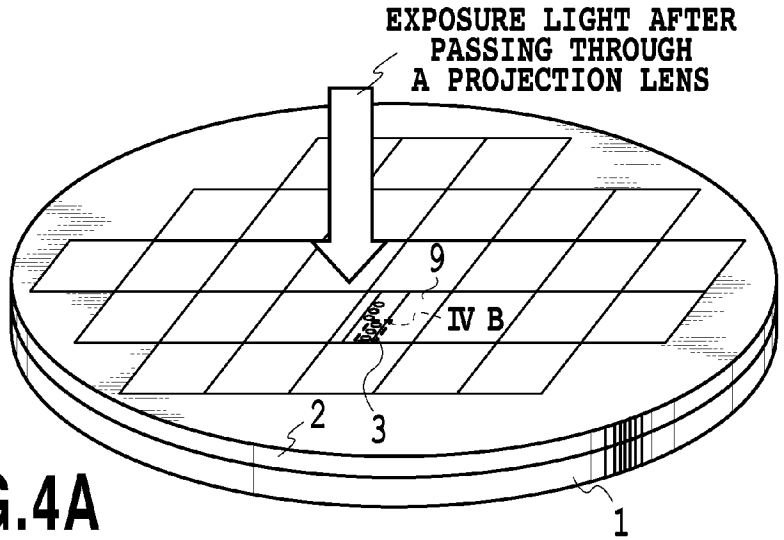
FIG. 4A is a drawing that illustrates a substrate formed by the above method, before ejection port exposure.
Figure 4B:
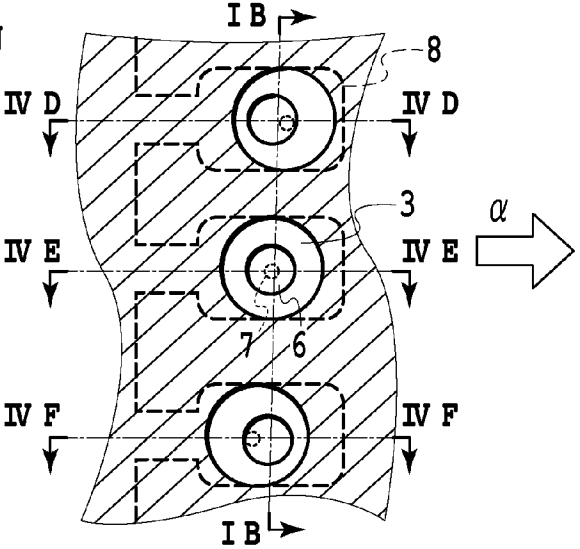
FIG. 4B is an enlarged plan view showing the region IVB.
Figure 4C:
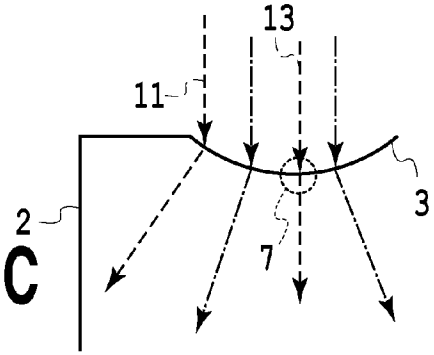
FIG. 4C is a cross sectional view showing the state in which ejection ports are formed.
Figure 4D:
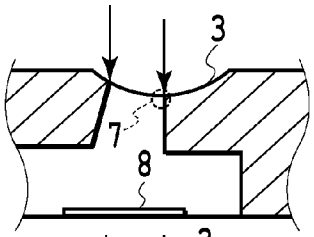
FIG. 4D is a view showing a cross section along IVD-IVD.
Figure 4E:
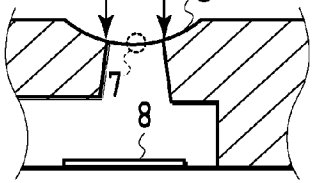
FIG. 4E is a view showing a cross section along IVE-IVE.
Figure 4F:
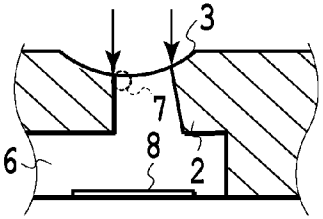
FIG. 4F is a view showing a cross section along IVF-IVF.

FIG. 4A is a drawing that illustrates a substrate formed by the above described method, before ejection port 6 exposure. FIG. 4B is an enlarged top view of the region IVB of FIG. 4A, and FIG. 4C is a cross sectional view that shows a state wherein the nozzle port 6 has been formed by exposure at the cavity 3. FIG. 4D is a drawing showing a cross section along IVD-IVD of FIG. 4B. FIG. 4E is a drawing showing a cross section along IVE-IVE of FIG. 4B. FIG. 4F is a drawing showing a cross section along IVF-IVF of FIG. 4B.

At FIGS. 4D to 4F the cavities 3 are formed such as to be deviated in the print scanning direction, with respect to the heat generation elements aligned in a row. On the other hand the ejection ports 6, at each of the nozzles, has the same positional relationship with respect to the heat generation elements 8. Here, an example of 3 ejection ports was explained, and as for the order in which liquid drops are ejected when printing, it is understood that the first cavity 3 is deviated in the direction of printing, shown by the arrow $\alpha$. As shown at FIG. 4C, as for light that has passed through the cavity 3, when it passes through a high curvature region, its inclination increases due to the effect of the concave lens. The light forms nozzles such as that of FIGS. 4D to 4F, according to the inclination of the light. At FIG. 4C a latent image for the nozzle is formed such that the light that is exposed at the high curvature portion of the cavity 3 bends greatly and has a larger taper angle.

On the other hand, as for the light 13 that passes at the vicinity of the lowest point 7 of the cavity 3, when it is directly incident the light advances approximately straight. Making use of this, it is possible to form the ejection port opening 6, which is inclined in the printing direction, with the patterning light 11 that is exposed at the high curvature portion and with the patterning light 13 that is exposed at the low curvature portion. After exposure, it is possible to form, by way of development, the ejection port 6, in which the direction of ejection is inclined in the direction opposite the direction in which the cavity 3 is staggered.

Figure 5A:
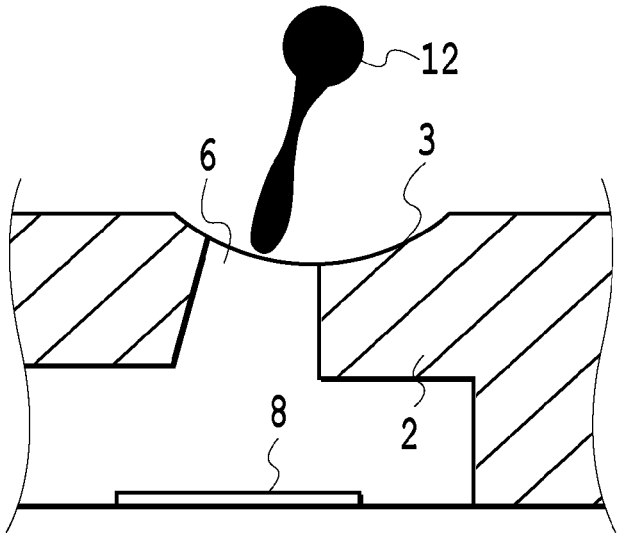
FIG. 5A is a drawing that illustrates the state in which liquid drops are ejected from an ejection port.
Figure 5B:
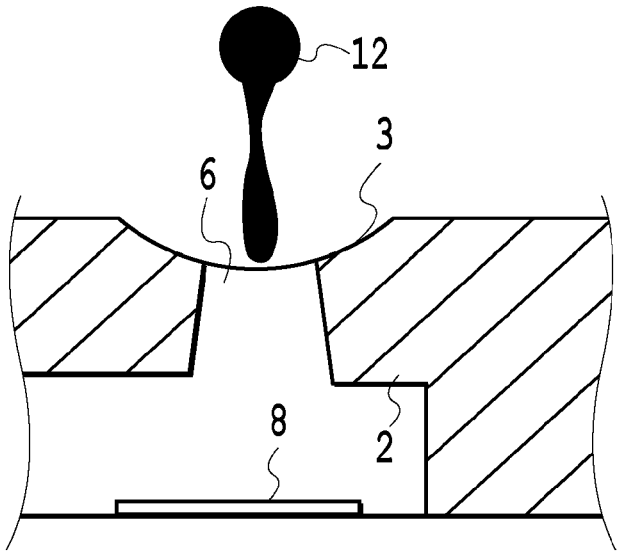
FIG. 5B is a drawing that illustrates the state in which liquid drops are ejected from an ejection port.
Figure 5C:
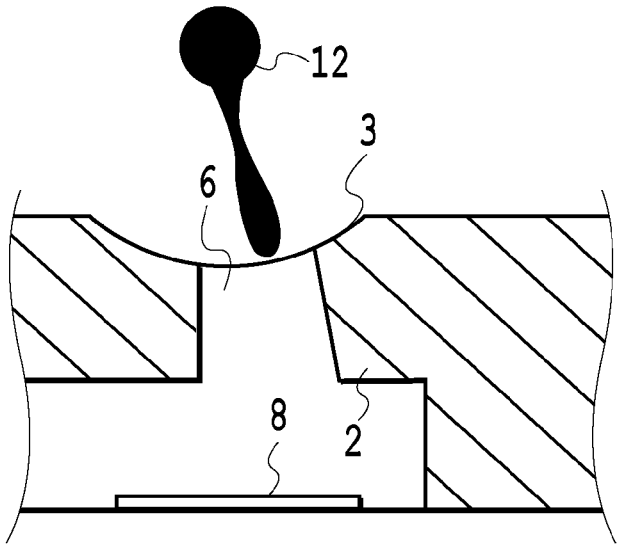
FIG. 5C is a drawing that illustrates the state in which liquid drops are ejected from an ejection port.
Figures 6A, 6B, 6C, 6D:
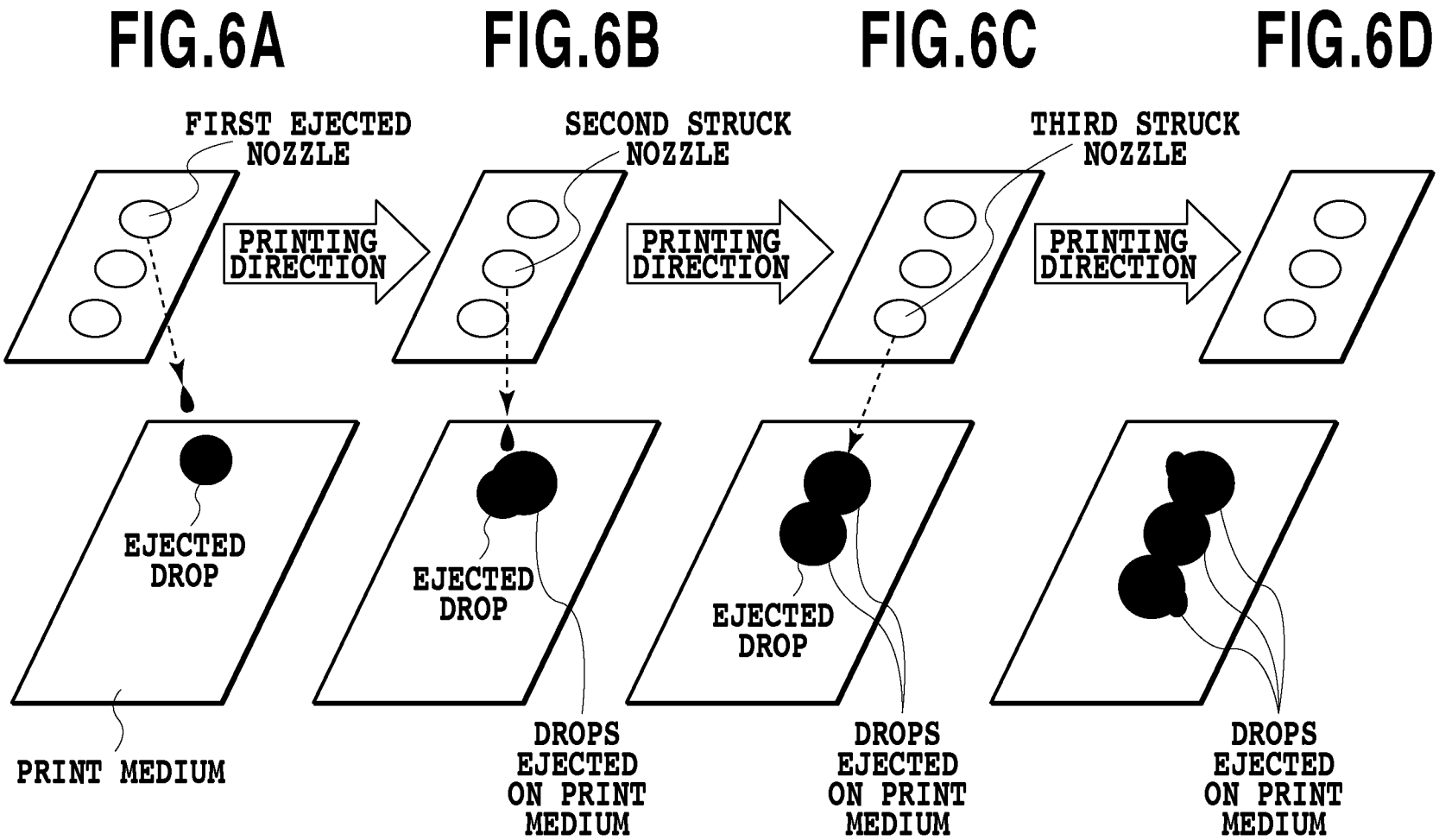
FIG. 6A is a drawing showing a print head and liquid drops ejected from its liquid ejection head.
FIG. 6B is a drawing showing a print head and liquid drops ejected from its liquid ejection head.
FIG. 6C is a drawing showing a print head and liquid drops ejected from its liquid ejection head.
FIG. 6D is a drawing showing a print head and liquid drops ejected from its liquid ejection head.

FIGS. 5A to 5C are is a drawings that illustrate the state in which liquid drops are ejected from an ejection port formed according to the method of the invention. A detailed explanation will be made below using FIGS. 5A to 5C and FIGS. 4D to 4F. As for FIG. 4D, in which the liquid-drop ejection order is the first among the three illustrated ejection ports, the lowest point of the cavity 3 is shifted in the printing direction (the direction of the arrow a) with respect to the ejection port 6, and the ejection port nozzle 6 is inclined in the printing direction. When configured in this manner, as shown by the ejection state at FIG. 5A, a liquid drop is ejected in the direction of printing.

As for FIG. 4E, the lowest point 7 of the cavity 3 is aligned with the center of the ejection port, and an upwardly perpendicular ejection port 6 is formed. When configured in this manner, as shown by the ejection state at FIG. 5B, a liquid drop is ejected in a perpendicular direction. As for FIG. 4F, the lowest point 7 of the cavity is shifted in the direction opposite the printing direction, with respect to the ejection port 6, and the ejection port 6 is formed to be inclined in the direction opposite the printing direction. When the ejection port 6 is formed in this manner, as shown at 5C, a liquid drop is ejected in a direction opposite the printing direction.

Because ejection from the ejection port 6 of FIG. 4F occurs last among the above 3 ejection ports when printing, if ejection does not occur in a direction that is rearward of that of the drops ejected from the other ejection ports, its landing position on the print medium will not be aligned. For this reason ejection occurs in a direction that is opposite the printing direction, as described above. In this manner a cavity 3 is arranged to be more deviated in the scanning direction with respect to the ejection port formation position, as the location corresponding to the ejection port 6 is ejected earlier.

FIGS. 6A to 6D are drawings that illustrate a print head manufactured according to the method of the invention and liquid drops that are ejected from its liquid ejection head. When the liquid ejection head is driven and a printing operation is performed, as shown at FIGS. 6A to 6D, the positions of the liquid drops that land on the print medium are aligned, and the liquid drops land in the state of one aligned row. Note that while a division driving concerning 3 ejection ports is shown here, in actuality 16 times division driving or 40 times division driving is common; the number is not restricted but the direction of inclination is decided according to order of ejection.

Usually in the case of 16 times division driving, etc., in order to avoid harmful effects on ejection such as crosstalk, adjacent nozzles are driven at times that are furthest apart as possible. Because of this the lowest points 7 of the cavities and the staggered directions of the centers of the ejection ports 6 are formed as if to alternate. Furthermore, according to the structure of the invention, there is also a merit wherein, because the position and shape of the open portion of the ejection port 6 do not change, deviation of the area of the ejection port 6, which would otherwise occur when performing multiple exposures when forming the ejection port 6 at an inclination, does not easily occur.

In addition, as with a 16 times division up to a 40 times division, because the direction of ejection can be inflected even more if the number of time divisions increases, it is possible to correct up to the portion that was not capable of being corrected by only shifting the center of the ejection port 6 and the center of the heat generation element 8. It is also possible to inflect ejected liquid drops without dependence on ejection amount of thickness of the ejection port 6 in the heightwise direction. Furthermore, it is possible to inflect ejected liquid drops without dependence on the shape of the heat generating element 8.

As described above, before performing exposure in order to form an ejection port, after forming a cavity that is shifted with respect to the location at which the ejection port is formed, exposure is performed. Accordingly, without being dependent on design changes, it was possible to achieve a liquid ejection head and a method of production thereof in which when time-division driving, liquid drop landing deviance in the printing direction is capable of correction.

2nd Embodiment

A second embodiment of the invention will be described below while referring to the drawings. Note that because the basic structure of this embodiment is the same as that of the first embodiment explanation will be made only with respect to the characteristic features.

The way of making the liquid ejection head 15 is the same method as that of the first embodiment, but although in the case of one-directional printing it is acceptable for the order of the ejection ports that eject to be of a single type, when performing a bidirectional printing there is a necessity to establish two or more types such that the ejection order is exactly opposite at the outbound direction and the inbound direction. In the case of bidirectional printing, because the printing direction changes, the inclinations of the ejection ports 6 reverse. Bidirectional printing cannot be realized if the ejection order is not reversed.

Thus in this embodiment ejection ports for outbound use and ejection ports for inbound use are respectively formed, such that even in the case where ejection order is reversed the positions of the liquid drops landing on the print medium are aligned, and the liquid drops land in a state that is aligned into 1 row. By designing in this manner, even in the case of bidirectional printing, on a head on which heat generation elements 8 are aligned in a row in a predetermined direction, the locations where a block is activated first and the locations where a block is subsequently activated are aligned, and it is possible to manufacture a high print quality liquid ejection head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-123398, filed Jun. 1, 2011, which is hereby incorporated by reference herein in its entirety.

What is claimed is:

1. A liquid ejection head for printing while moving relatively to a print medium in a movement direction, comprising:

a substrate having an energy generating element for generating energy that is used for ejecting liquid; and a photosensitive resin member which is formed on the substrate and which has arc-shaped cavities formed on one surface and ejection ports for ejecting liquid, the ejection ports being formed inside the cavities, wherein the ejection ports include a first ejection port formed inside a first cavity and a second ejection port formed inside a second cavity, and an opening center of the first ejection port is behind a deepest portion of the first cavity relative to the movement direction, and an opening center of the second ejection port is ahead of a deepest portion of the second cavity relative to the movement direction, when viewed from a direction perpendicular to the substrate.

2. The liquid ejection head according to claim 1, wherein the liquid is ejected from the second ejection port after the liquid is ejected from the first ejection port.

3. The liquid ejection head according to claim 1, wherein the liquid is ejected from the first ejection port in a direction which is inclined forward with respect to the movement direction relative to the direction perpendicular to the substrate.

4. The liquid ejection head according to claim 1, wherein the liquid is ejected from the second ejection port in a direction which is inclined backward with respect to the movement direction relative to the direction perpendicular to the substrate.

5. The liquid ejection head according to claim 1, wherein the ejection ports have a tapered shape gradually reduced in diameter in a direction of the ejection of the liquid.

6. A liquid ejection head, comprising:

a substrate having energy generating elements for generating energy that is used for ejecting liquid; and a member which is formed on the substrate and which has arc-shaped cavities formed on one surface and ejection ports for ejecting liquid, the ejection ports being formed inside the cavities, wherein the ejection ports include a first ejection port formed inside a first cavity and a second ejection port formed inside a second cavity, and an opening center of the first ejection port is deviated from a deepest portion of the first cavity in a first direction, and an opening center of the second ejection port is deviated from a deepest portion of the second cavity in a second direction opposite to the first direction, when viewed from a direction perpendicular to the substrate.

7. The liquid ejection head according to claim 6, wherein the first ejection port is inclined in the second direction relative to the direction perpendicular to the substrate, and the second ejection port is inclined in the first direction relative to the direction perpendicular to the substrate.

* * * * *